US007489593B2

(12) United States Patent
Nguyen-Dinh et al.

(10) Patent No.: US 7,489,593 B2
(45) Date of Patent: Feb. 10, 2009

(54) ELECTROSTATIC MEMBRANES FOR SENSORS, ULTRASONIC TRANSDUCERS INCORPORATING SUCH MEMBRANES, AND MANUFACTURING METHODS THEREFOR

(75) Inventors: An Nguyen-Dinh, Valleres (FR); Nicolas Felix, Tours (FR); Aimé Flesch, Andrésy (FR)

(73) Assignee: Vermon, Tours Cedex (FR)

( * ) Notice: Subject to any disclaimer, the term of this patent is extended or adjusted under 35 U.S.C. 154(b) by 624 days.

(21) Appl. No.: 10/998,952

(22) Filed: Nov. 30, 2004

(65) Prior Publication Data

US 2006/0116585 A1 Jun. 1, 2006

(51) Int. Cl.
*H04R 19/00* (2006.01)

(52) U.S. Cl. ..... 367/181

(58) Field of Classification Search ..... 367/7, 367/140, 181; 600/459; 310/309
See application file for complete search history.

(56) References Cited

U.S. PATENT DOCUMENTS

| | | | | |
|---|---|---|---|---|
| 5,619,476 | A | 4/1997 | Haller et al. | |
| 5,870,351 | A | 2/1999 | Ladabaum et al. | |
| 5,894,452 | A | 4/1999 | Ladabaum et al. | |
| 5,982,709 | A | 11/1999 | Ladabaum et al. | |
| 6,443,901 | B1 * | 9/2002 | Fraser | 600/459 |
| 7,030,536 | B2 * | 4/2006 | Smith et al. | 600/459 |
| 7,074,634 | B2 * | 7/2006 | Foglietti et al. | 438/53 |
| 7,257,051 | B2 * | 8/2007 | Thomenius et al. | 600/459 |
| 2004/0180466 | A1 * | 9/2004 | Foglietti et al. | 438/53 |
| 2005/0219953 | A1 * | 10/2005 | Bayram et al. | 367/178 |
| 2006/0116585 | A1 * | 6/2006 | Nguyen-Dinh et al. | 600/459 |
| 2007/0038110 | A1 * | 2/2007 | Flesch et al. | 600/459 |
| 2007/0193354 | A1 * | 8/2007 | Felix et al. | 600/459 |
| 2008/0067895 | A1 * | 3/2008 | Adachi et al. | 310/324 |
| 2008/0184549 | A1 * | 8/2008 | Nguyen-Dinh et al. | 29/594 |

FOREIGN PATENT DOCUMENTS

| | | |
|---|---|---|
| WO | WO 02/091796 | 11/2002 |

* cited by examiner

*Primary Examiner*—Dan Pihulic
(74) *Attorney, Agent, or Firm*—Stites & Harbison PLLC; Ross F. Hunt, Jr.

(57) ABSTRACT

A micro-machined ultrasonic transducer substrate for immersion operation is formed by a particular arrangement of a plurality of micro-machined membranes that are supported on a silicon substrate. The membranes, together with the substrate, form surface microcavities that are vacuum sealed to provide electrostatic cells. The cells can operate at high frequency and can cover a broader bandwidth in comparison with conventional piezoelectric bulk transducers.

18 Claims, 6 Drawing Sheets

ELECTROSTATIC MEMBRANES FOR SENSORS, ULTRASONIC TRANSDUCERS INCORPORATING SUCH MEMBRANES, AND MANUFACTURING METHODS THEREFOR

FIELD OF THE INVENTION

The present invention relates to cells for ultrasonic transducers and, more particularly, to a construction of electrostatic membranes wherein at least two superposed electrodes are provided in a manner that optimizes the emission and reception functions independently, to multilayered membranes which are capable of exhibiting a variety of physical characteristics, and to manufacturing method therefor.

BACKGROUND OF THE INVENTION

Currently, ultrasonic transducers are typically formed of piezoelectric materials for transmission and reception of interrogating ultrasonic waves transmitted through biologic tissues or materials. The corresponding piezoelectric elements are commonly made from polycrystalline ceramics such as lead-zirconate-titanate or ceramic-polymer composites having ceramic rods embedded in a matrix of resin. The intrinsic advantages of piezoelectric transducers are well known in the art and include such advantages as high energy conversion factors and suitability for low volume production. Unfortunately, the shortcomings of this technology are numerous as well, and the various disadvantages include a low reproducibility of the piezoelectric characteristics, aging and temperature sensitivity, and a lack of suitability for mass production or complex miniaturization.

Since the 1960s, other forms of ultrasonic transducers have been developed and disclosed in the prior art which use an electrostatic force for moving capacitive membranes. The basic principle is quite simple and has been successfully implemented in condenser microphones having passive components. For capacitive transducers, the operation is governed by a voltage oscillation over its electrostatic field. This oscillation causes the membrane to vibrate, therefore producing the emission of ultrasonic waves. Conversely, the reception of a pressure force at the surface of biased membranes will cause deformation of the surface thereby resulting in oscillation of the output voltage. Unlike piezoelectric transducers that perform very well with solid interfaces, capacitive membrane transducers are more suitable in air and liquid based applications. The capacitive membranes are commonly microfabricated on a silicon substrate using etching technologies used for CMOS circuits.

One such transducer is called a Capacitive Micromachined Ultrasonic Transducer (CMUT). CMUT devices can be obtained using well known semiconductor manufacturing processes similar to those employed in CMOS or Bi-CMOS technologies.

Considering these devices in more detail, the diameter and thickness of the membranes are defined according to desired characteristics of the transducer. In most cases, the CMUT cells are preferably microfabricated on a suitable material substrate such as silicon (Si). Because the diameter of CMUT cells are governed by the operating frequency of the transducer, the sizes range from a few microns to dozens of microns. Therefore, to form the complete surface of the transducer, hundreds or thousands of cells must then be electrically connected in parallel. The transducer so obtained can also easily be combined with electric impedance matching circuitry or control circuitry to form an integrated transducer assembly ready to be housed or cable connected. The packaging used is defined or determined upon request according to the particular applications or customer specifications.

The manufacture of CMUT cells for immersion transducers has been disclosed in the prior art. For example, U.S. Pat. No. 5,894,452 to Ladabaum et al discloses cells formed from a highly doped silicon substrate having membrane supports of silicon dioxide and sealed membranes of silicon nitride.

U.S. Pat. No. 5,619,476 to Haller et al. discloses an electrostatic ultrasonic transducer in combination with a manufacturing method which seeks to avoid collapsing of the nitride membrane during the etching process. Membranes of circular and rectangular shapes are also described.

In U.S. Pat. No. 5,870,351 to Ladabaum et al., a broadband microfabricated ultrasonic transducer is disclosed wherein a plurality of resonant membranes of different sizes are provided. Each size of membrane is responsible for a predetermined frequency so an extended bandwidth for the transducer can be expected. Further, the membranes may be made in various forms and shapes.

Another aspect of membrane fabrication is taught in U.S. Pat. No. 5,982,709 to Ladabaum et al, wherein polysilicon or silicon nitride membranes are deposited on a support structure specially tailored to minimize the effect on the vibration of the membranes. Typically, etching holes are formed in the area external to the membranes so as to not disturb the operation thereof.

WO 02091796A1 to Foglietti et al discloses the use of silicon monoxide as support material for membranes. In one embodiment, a chromium sacrificial material is employed and, alternatively, an organic polymer (polyamide) may be used. The chemical etching of chromium or polyamide is more selectively controlled as compared with silicon dioxide. The polyamide material is spin coated and then dry etched in a manner such as to control the thickness (500 nm.) This, in turn, governs the gap provided between the membrane and the substrate. A PECVD process is used for film growth.

It will be understood that with respect to the above-described prior art, electrostatic cells for ultrasonic transmissions must be designed according to the operating specifications, i.e., center frequency, bandwidth and sensitivity. These specifications are interdependent, i.e., are cross-linked to each other through the design of the cells. In this regard, it is well known that the frequency and bandwidth of transducer are governed by the diameter and thickness of the membranes and, in general, the gap between the membranes/substrate and the thickness of membrane contribute to the control of the collapse voltage and thus to the sensitivity of the cells. Obviously, such factors as the stiffness (Young's modulus) of the membrane and the membrane geometry will also play major roles in the acoustical operations of the cells.

In general, and for operations involving ultrasonic applications, in emission (transmission) operations, the maximum Coulombian force is required on the membrane in order to provide a high displacement amplitude of the membrane. This force should, however, be controlled so as to prevent collapse of the membrane onto the cavity bottom surface. In reception operations, where a pressure force is exerted on the membrane surface, the electrical sensitivity is governed both by the biasing voltage and the capacitance observed between the electrodes. Reduction of the membrane thickness inherently leads to a decrease in the biasing voltage, thereby optimizing the reception voltage measured on the cells.

In the related prior art, no cell or transducer construction has fully taken into account the particularities of the emission and reception of ultrasounds by the electrostatic components discussed above, so there is a need for an electrostatic cell wherein integrated emission and reception functions are provided independently, together with optimization of each particular function and without impacting on the operations of the other.

SUMMARY OF THE INVENTION

One object of the invention concerns the provision of a capacitive micromachined ultrasonic transducer (CMUT) for detection and imaging applications using multilayer electrodes embedded within the membrane thickness in a manner such as to maximize the energy conversion provided by the electrostatic cells.

A further object of the invention concerns the provision of an associated method of manufacturing of such a membrane which is capable of providing separate emission and reception functions.

As indicated above, the present invention relates to Capacitive Micromachined Ultrasonic Transducer devices, i.e., called CMUT devices, and, more particularly, to electrostatic cell and/or membranes designs and constructions. As was also indicated above, a further aspect of the invention concerns methods of manufacturing such electrostatic cells and membranes. These methods include the provision of separate transmission and reception devices wherein superposed or multilayered electrodes are embedded in the same membrane thickness. A further aspect of the invention concerns the provision of a membrane of multilayered structure comprising materials of similar or different characteristics.

A CMUT transducer constructed in accordance with one aspect of the invention includes at least one silicon substrate or, more, preferably, highly doped (P-doped) silicon, although in some constructions a glass substrate can also be used. An insulator layer of a suitable insulation material is deposited on the surface of the substrate. The layer has a etching pattern corresponding to the geometry of cells to be provided. Thereafter, a thin membrane is deposited on the surface of the insulator layer and selected etching of the insulator layer is then carried out to form the cells. The upper electrodes are produced during the deposition process of the membrane so that the electrodes are layered.

Preferably, the CMUT substrate also includes microholes for the etching of the insulator sacrificial layer underneath the membrane material; these holes are vacuum sealed at the completion of the etching operation.

As discussed below, in accordance with another aspect of the invention, a CMUT transducer is made using well known microfabrication methods which are conventionally employed in the semiconductor art and which are modified so as to efficiently and effectively implement the transducer.

Further features and advantages of the present invention will be set forth in, or apparent from, the detailed description of preferred embodiments thereof which follows.

BRIEF DESCRIPTION OF THE DRAWINGS

The present invention as defined in the claims can be better understood with reference to the following drawings, it being understood that the components shown in the drawings are not necessarily to scale relative to one other.

FIG. 4(*a*) is a detail of a portion of FIG. 4 indicated in dashed lines.

DETAILED DESCRIPTION OF PREFERRED EMBODIMENT

One aspect of the present invention, as will be described in more detail hereafter, is particularly applicable to CMUT devices for ultrasonic applications wherein there is an advantage to providing the devices with separate sources for the emission and reception of ultrasonic energy. The resulting ultrasonic device using a multilayered CMUT is capable of transmitting acoustic energy at one frequency by connection thereof to a suitable electrode and of receiving acoustic energy at another frequency significantly different from that of transmission mode by simply providing a connection to the dedicated electrode for this purpose, i.e., the dedicated receiving electrode. The electrodes for both the transmission and reception modes are laminated into the thickness of the membrane of CMUT device, thereby wholly integrating the two functions into the device.

Still another aspect of the invention concerns the provision of CMUT multilayered membrane wherein the connection of one front electrode or the other electrode or both electrodes provides a membrane collapse voltage that controls the output displacement and sensitivity of the associated CMUT cells.

As set forth above in the description of the prior art, several CMUT compatible silicon microfabrication processes are available for use in ultrasonic transducers. These fabrication processes all exhibit advantages and inherent shortcomings that are well known in the related art.

Despite the fact that a principal object of the present invention is not concerned with, and does not relate to, any particular wafer fabrication process, manufacturing of the device preferably involves using standard CMOS processes widely employed in the electronics industry. The description of the preferred embodiment will, therefore, be particularly based on, prior art CMOS process regarding the wafer machining. However, as will be obvious to one of ordinary skill in the related art, the following description is not intended to limit the invention to a particular wafer manufacturing process.

In the following description, the terms substrate, wafer and plate are used interchangeably to designate the preferably silicon carrier for the electrostatic device. Further, the terms sensors and transducers are both used to designate the devices that are capable of emitting and receiving ultrasonic energy and of transforming this energy into another kind of energy, and vice versa. Each single transducer or sensor is formed by the association therewith of an electrostatic membrane, a cavity and portions of the corresponding electrodes. The term cells is used herein to refer to a single complete elemental transducer.

Figure 8:
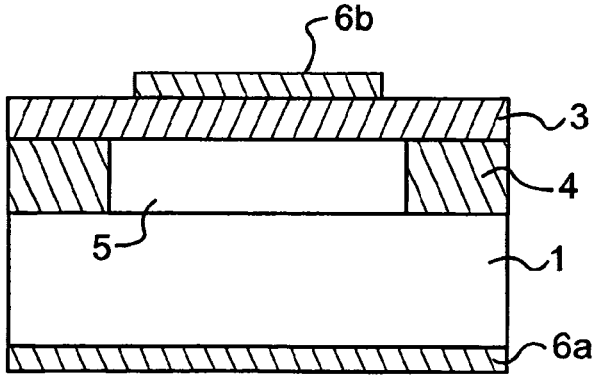
FIG. 8 PRIOR ART
FIG. 8 is a cross sectional view of a prior art CMUT transducer.

According to the related prior art, and with specific reference to FIG. 8, a prior art electrostatic device is illustrated in FIG. 8 which is adapted to convert electrical energy into acoustic energy and vice versa. The device includes a silicon substrate 1 having a bottom electrode 6*a* deposited by a sputtering or evaporation process, and a sacrificial layer 4 is provided on the upper face of the substrate 1. Sacrificial layer 4 is wet etched to form a cavity 5 necessary to the operation of the cell. A membrane 3 of nitride silicon material covers the surface of the sacrificial layer 4 to provide sealing of cavity 5. Finally, an electrode 6*b* is provided on the top of the membrane to form the complete CMUT transducer.

Many variations in this basic construction are disclosed in the prior art. For instance, an anti-sticking surface treatment may be provided on the bottom face of cavity 5, membrane 3 may be manufactured from polysilicon, a tapered cavity may be provided, etc. However, all prior art designs use a capacitance effect exerted on the dielectric membrane to produce vibration of the latter.

Figure 1:
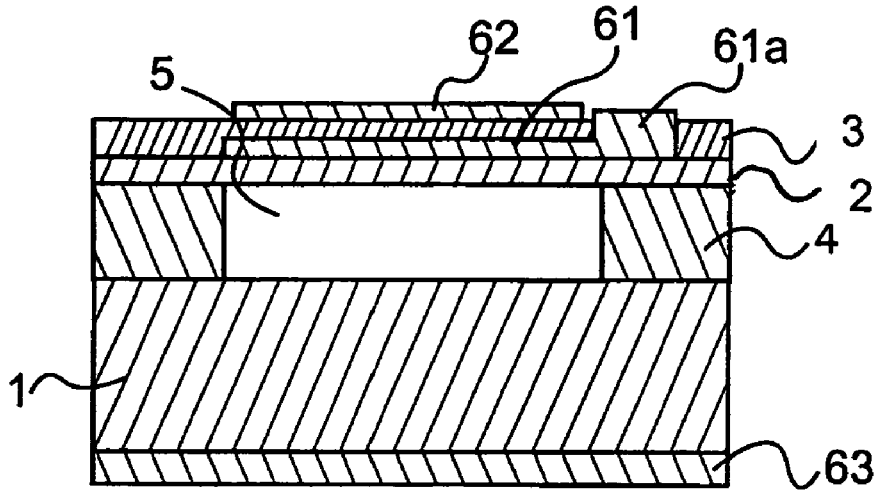
FIG. 1 is a cross sectional view of an elementary CMUT cell in accordance with the present invention.

A preferred embodiment of the present invention can be better understood in connection with the accompanying illustration provided in FIG. 1 wherein similar elements have been given the same reference numerals as in FIG. 8. In FIG. 1, a substrate 1 is made from highly doped silicon, and is referred to as the carrier for the electrostatic cells. An intrinsic silicon substrate can also be used with the addition of a metal electrode deposited in the cavity of cells on the surface of the substrate.

In the next step, a silicon oxide ($SiO_2$) layer 4 is deposited on one or both surfaces of the substrate 1 to insure electrical insulation of the substrate. Preferably, this deposition has a thickness ranging from tens to hundreds of nanometers. As in FIG. 8, the silicon oxide layer 4 on the upper surface of substrate 1 serves as a sacrificial layer. and has at least one cavity 5 therein.

An electrode 63 is provided on the bottom surface of substrate 1 so as to form the common electrode of the transducer.

A layer of silicon nitride 2 forming a first nitride membrane is next deposited on the sacrificial layer 4. For example, the deposition of layer 2 may be carried out using a LPCVD (Low Pressure Chemical Vapor Deposition) process in order to obtain a low stressed layer 2 on the front face of the device. Typically, a residual stress of 250 MPs for the nitride layer is desired but other stress values can also be considered depending upon the specifications of the transducer.

A first front electrode 61 is next provided at this stage of manufacturing. The electrode 61 can, for example, be provided by a sputtering process so as to have a 50 nm thickness. Electrode 61 has a thicker portion 61*a* which provides a connection on the surface of the transducer.

Deposition of a second nitride membrane 3 is then carried out to cover the main surface of electrode 61. The thickness of membrane 3 preferably ranges between 100-150 nm.

Finally, a second front electrode 62 is deposited on the surface of membrane 3, in front of cavity 5, so as to complete the transducer fabrication. It is noted that electrodes 61 and 62 are preferably connected separately to their respective collector electrodes (not shown) in order to enable the system to select the desired mode of operation.

Figure 2:
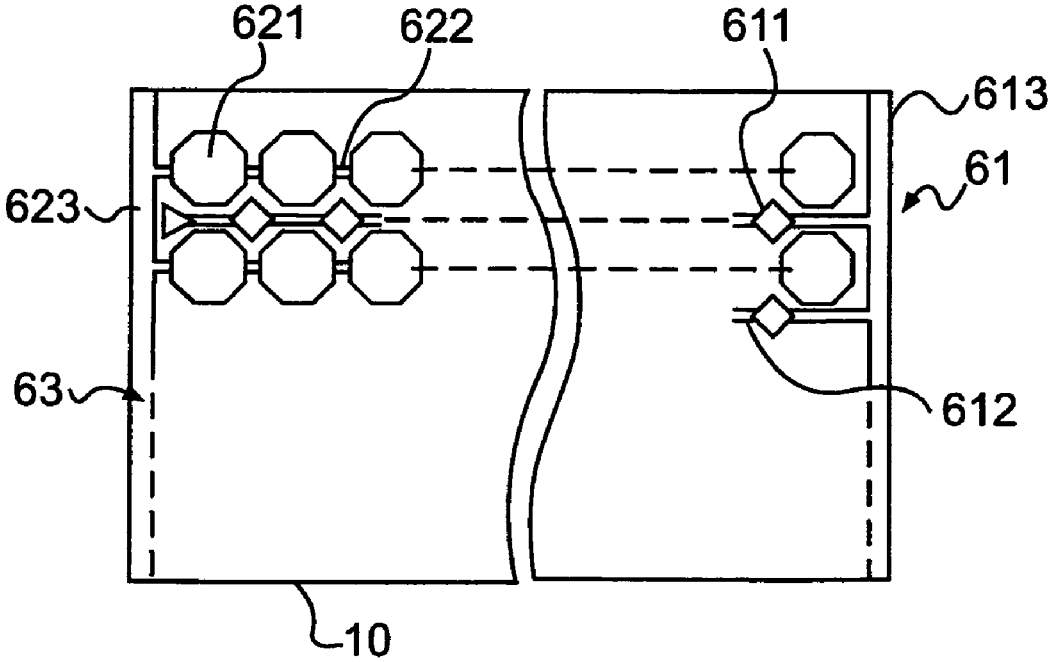
FIG. 2 is a top plan view of an exemplary CMUT transducer having a polygonal cell architecture in accordance with a one implementation of the invention.

FIG. 2 illustrates the front surface configuration of an acoustic transducer wherein a plurality of electrode pads 621 corresponding to the second front electrode 62 of FIG. 1 are provided. The single electrodes or electrode rods 621 are all connected together via interconnections 622. In the preferred embodiment, the single electrode pads 621 are arranged linearly and connected on one side to an electrode collector 623.

Further electrode pads 611 are, in turn, electrically connected together via interconnections 612 and are shunted together to a further collector 613.

It is important to understand that the electrode pads 611 visible on the main transducer surface in FIG. 2 correspond to the exposed visible parts 61*a* of electrodes 61 as set forth above, and the interconnection of a plurality of electrodes (and, therefore, membranes) forms an acoustic transducer (due to the area of the membrane).

In the embodiment of FIG. 2 the electrode pads 611 and 621 are of polygonal shapes chosen to optimize use of the transducer surface, even though the drawing is not to scale.

Figure 3:
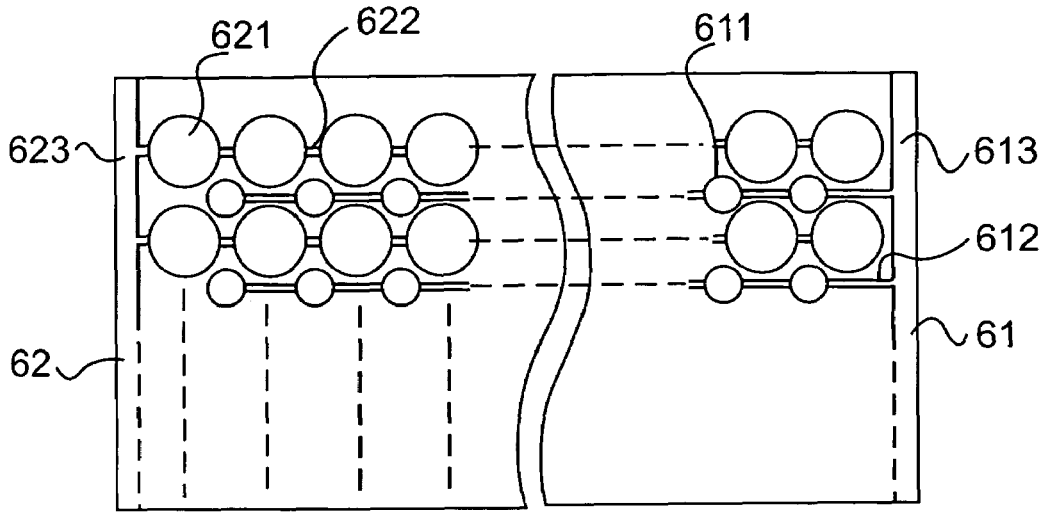
FIG. 3 is a top plan view of an exemplary CMUT transducer having a circular cell architecture in accordance with a further implementation of the invention.

A similar acoustic transducer is shown in FIG. 3 wherein the electrode pads 621 and 611 are of a circular shape. In this embodiment, interconnections 622 and 612, as well as collectors 623 and 613, remain unchanged.

Figure 4:
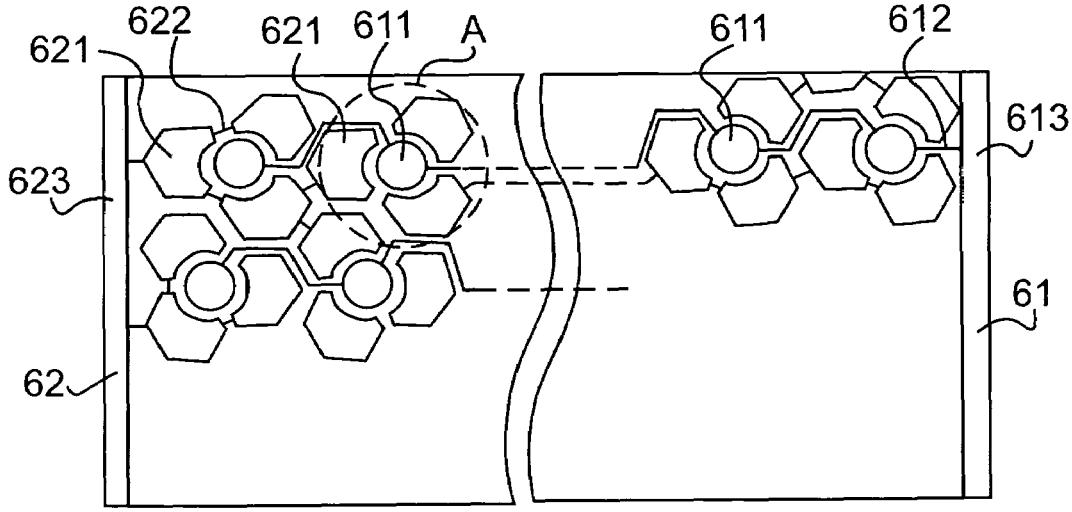
FIG. 4 is a top plan view of an exemplary CMUT transducer having "honey comb" cell architecture in accordance with yet another implementation of the invention.
Figure 4A:
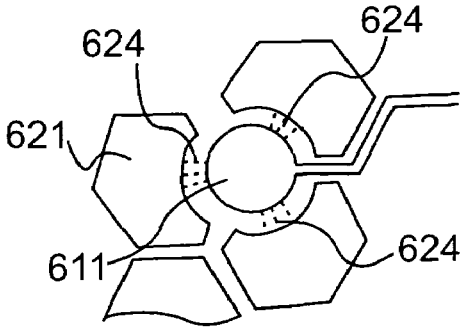
Figure 5A:
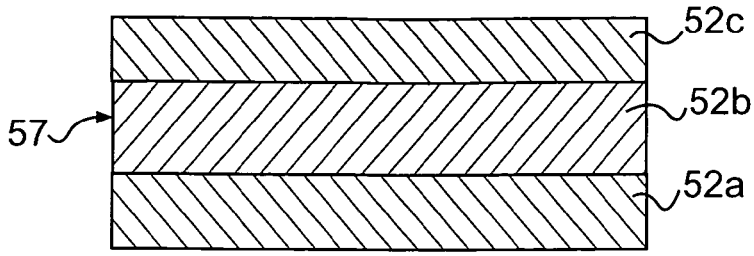
FIGS. 5(*a*) to 5(*k*) are cross sectional views showing successive steps in a CMUT fabrication process in accordance with a further aspect of the invention.
Figure 5B:
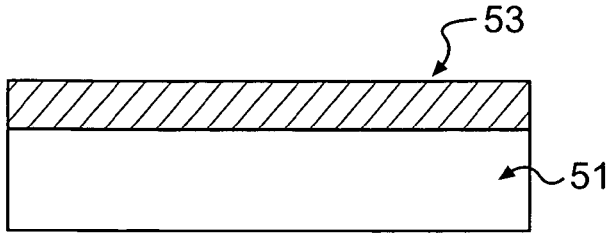
Figure 5C:
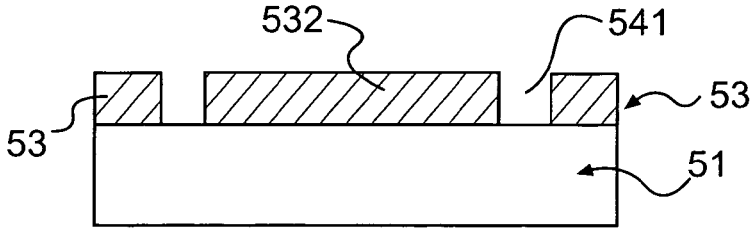
Figure 5D:
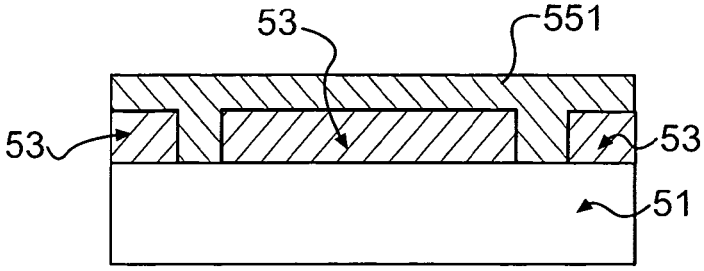
Figure 5E:
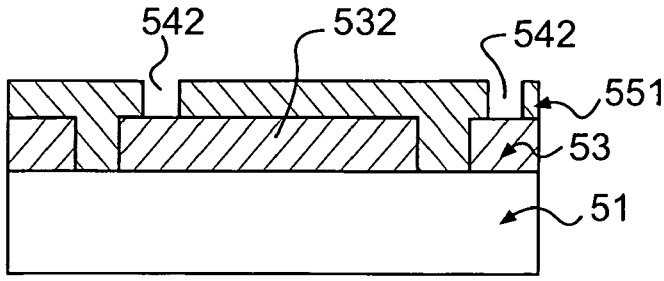
Figure 5F:
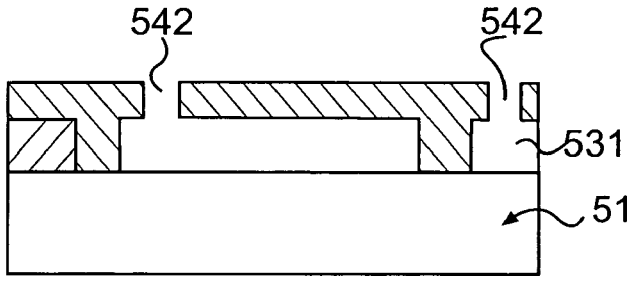
Figure 5G:
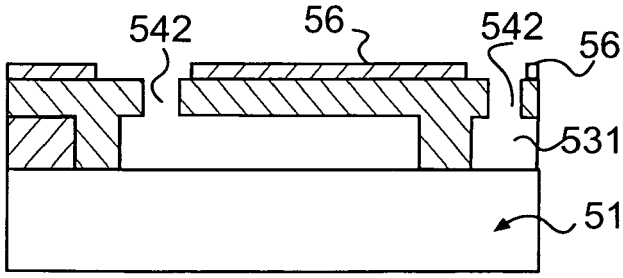
Figure 5H:
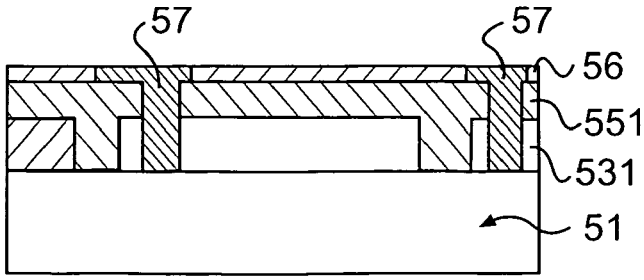
Figure 5I:
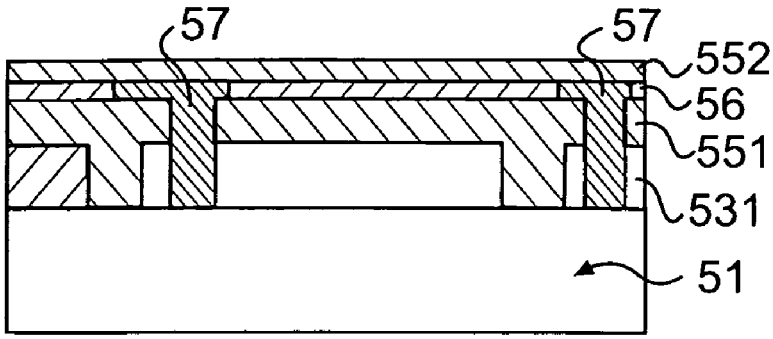
Figure 5J:
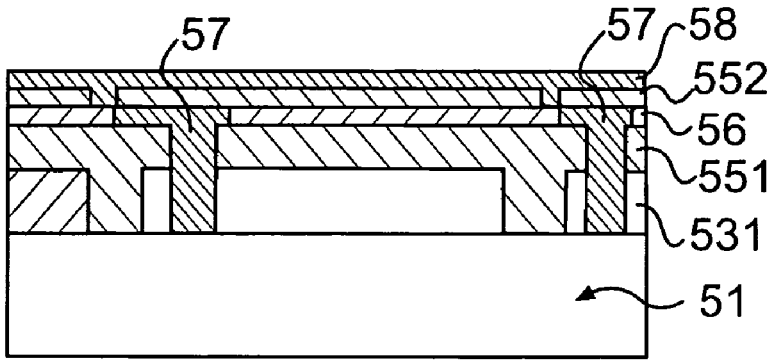
Figure 5K:
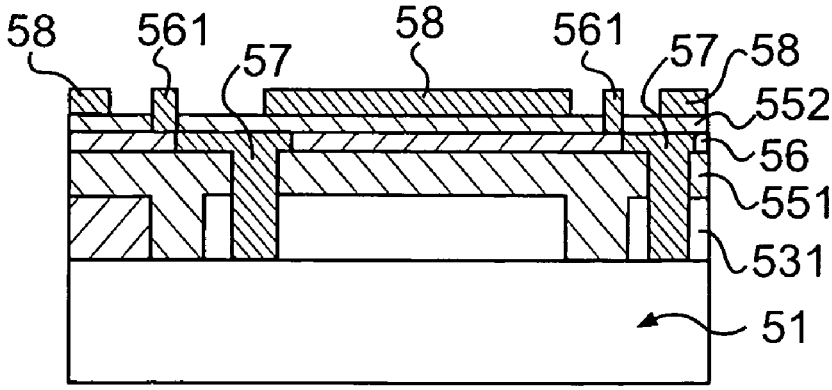

As previously described in connection with FIGS. 2 and 3, the main transducer surface is fully occupied by membrane electrodes which are arranged in a manner such as to optimize or maximize the active surface of the device. This optimization can be improved even further by employing the particular configurations of electrode shapes and arrangements illustrated in FIG. 4. As shown, in FIG. 4, three polygonal electrode pads 621 are arranged in a manner so as to surround a circular shaped electrode pad 611. The corresponding configuration can be viewed as a "honey comb" construction on the surface of the transducer. The electrode pads 621 are connected together by interconnections 622 and 612 defined between the interstices of the electrodes 621. This can be best seen in FIG. 4(*a*) which is an enlarged view of area A of FIG. 4. It will be appreciated that, electrode pad 611 connects, at an "underground" level, the electrodes of the first membrane 2 of FIG. 1 through interconnections 624 that are not visible from outside of the device. It is noted that the spaces between the electrode pads 621 and 611 and interconnections 622 and 612 are very small and can be as small as few microns.

Figure 6:
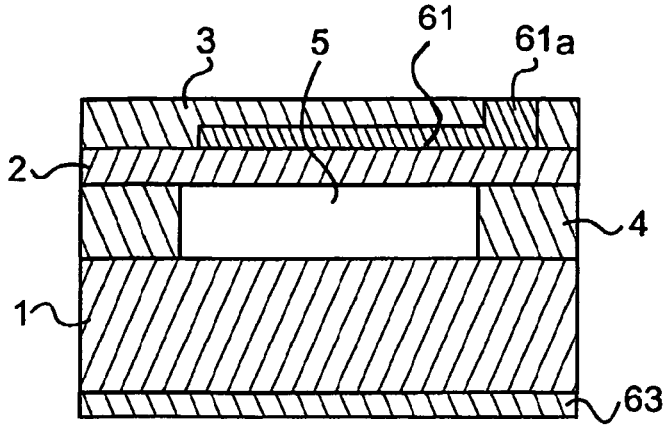
FIG. 6 is a cross sectional view of a further embodiment of the present invention.

Referring to FIG. 6, a further embodiment of the invention is illustrated. FIG. 6 shows a cross section of a silicon acoustic transducer that comprises a silicon substrate 1 which includes a bottom electrode 63 plated thereon, a membrane support 4, preferably made of silicon dioxide is disposed on substrate with a cavity 5 formed therein preferably by wet etching. A first membrane 2 preferably made of silicon nitride or polysilicon is provided on membrane support 4 thereby sealing the cavity 5. An electrode 61 with a thickened portion 61 a is deposited on the first membrane 2 and a second membrane 3 is deposited over the electrode 61 and first membrane 2 to complete the construction. It is generally desirable to make the thickness of membrane 3 over the surface of electrode 61 as small as possible so as not to disturb the operation of the membrane 3.

The construction of the electrostatic membrane arrangement according to FIGS. 1 and 6 has various advantages. When the first and second membranes 2 and 3 are assembled in position over the cavity 5 to form a capacitive cell, the multilayered membrane construction exhibits specific stiffness and elastic properties that are not achievable by the monolithic membranes disclosed in the prior art. In specific implementations of the present invention, the first and second membranes 2 and 3 have one of the following relationships between the thicknesses thereof so as to customize their physical behavior: the membranes 2 and 3 are of same thickness, the first membrane 2 is thicker than the second membrane 3, and the first membrane 2 is thinner than second membrane 3. Similarly, different membrane materials can also be used to make the first and second membranes 2 and 3 in order to provide desirable properties, such as different embodiments of polysilicon/silicon nitride. Further, different combinations of membrane thickness and membrane materials can be used to provide a number of membrane characteristics that can be adapted to satisfy particular applications.

Manufacturing of the preferred embodiments of the invention can be carried out as described below. However, it will be understood that the method here in described is intended to demonstrate the feasibility of making the transducer device through the use of standard silicon machining process and is only one of a number of suitable methods for making micromachined membranes on silicon substrates. Accordingly, the manufacturing methods of the present invention are not limited to the process described below.

Considering to the preferred manufacturing method illustrated FIG. 5(*a*) to 5(*k*), an initial step of the micromachining process is depicted in FIG. 5(*a*). Specifically, FIG. 5(*a*) shows cross section of a substrate 51 which comprises a silicon wafer 52*a* having a thickness of around 500 μm in an exemplary implementation. A layer of oxide 52*b* is then grown on the top surface of silicon wafer 52*a*, and a polysilicon film 52*c* is deposited over the oxide layer 52*b* to complete substrate 51. Growth of oxide and polysilicon layers can be carried out at temperatures respectively 1050° C. and 600° C. in a Centrotherm furnace, for instance. It is noted that layer 52*c* will serve as inferior electrode for the CMUT cells.

FIGS. 5(*b*) and 5(*c*) depict the deposition and etching of the sacrificial layer of the CMUT device. In particular, a silicon oxide sacrificial layer 53, preferably of a few hundreds of nanometers in thickness is deposited (as illustrated in FIG. 5(*b*)) on the top surface of substrate 51. Sacrificial layer 53 is advantageously provided in a column structured phosphorous based material having high etching rate, i.e., an oxide deposited by PECVD. A resist film (not shown) is then patterned on layer 53 and the layer 53 is dry etched (FIG. 5(*c*)) to form channels that define shaped oxide islands 532. The thickness of the sacrificial layer 53 will determine the cavity depth of the CMUT cells. Usually, and particularly for Megahertz frequency transducer devices, the thickness (height) of the cavities ranges between 50 to 200 nanometers and the diameter of the cavities ranges between about 50 to 100 microns.

FIGS. 5(*d*) to 5(*f*) depict the operations associated with making the membranes for the CMUT cells. A silicon nitride layer 551 is obtained by low pressure chemical deposition (LPCVD) as illustrated in FIG. 5(*d*). Layer 551 has a thickness ranging between few dozens of nanometers and hundred of nanometers. In a manner such as to enable access to the sacrificial material, a resist film (not shown) is patterned lithographically, or using a E-beam, on the nitride layer 551 and a dry etching operation is then performed so as to create openings 542. As shown in FIG. 5(*e*) openings 542 extend to the areas occupied by the sacrificial layer 53 or, more precisely, by the oxide islands 532.

In the next step which is illustrated in FIG. 5(*e*), the sacrificial oxide material 53 is removed by immersion into a buffered hydrofluoric acid (BHF) solution. Preferably, the etching rate of oxide material 53 is controlled in a manner so as to maintain membrane integrity. It has been demonstrated that oxides that are deposited using techniques like plasma enhanced chemical vapor deposition (PECVD) enable use of the highest etching rates for the method being described. The void spaces 531 remaining after etching constitute the cavities of the cells as described above. In one example of cell constructions, the openings 531 are produced at the corner, or the periphery, of the oxide islands 532 in order to minimize the impact on the vibration of the resilient membrane.

In a further step illustrated in FIG. 5(*g*), an aluminum electrode 56 is sputtered, and patterned by dry etching, on the surface of silicon nitride layer 551 to form the top electrode of the CMUT device. Electrode 56 can also be made of copper, silver or gold with no significant difference in the performance of the transducer.

Finally, FIG. 5(*h*) shows the cavities 531 after being vacuum sealed by the deposition of a sealing material 57 that fills the openings 542. The preferred materials that are suitable for a CMUT sealing operation include dielectric materials such as SiNx, LTO (low temperature oxide) and PVD (physical vapor deposition) oxide.

At this stage, the resultant CMUT device is functional since the membrane 551 covers the cavity 531 on the carrier 51 (which also acts as the bottom electrode). However, in this particular embodiment, a second silicon nitride layer 552 is deposited by LPVCD process as shown (FIG. 5(*i*)) and entirely covers the front surface of the device. The thickness of the second nitride layer 552 is roughly the same than that of the first nitride layer 551 shown in FIG. 5(*d*). As aforementioned, the residual stress remaining in the nitride layer 552 can be made to be equal to or different from that of layer 551 so as to produce the desired functional characteristics of the final membrane construction. As described above in connection with FIG. 1, the thicknesses of nitride layers 551 and 552 can either be equal to each other or different from each other depending upon the desired flexibility and behavior of the membrane.

Once the deposition of nitride layer 552 is complete, a resist film (not shown) is again patterned on the surface of layer 552 and new openings are then created by dry etching to enable direct access to the electrode 56 underneath. As shown in FIG. 5(*k*) electrode 58 is then sputtered over the surface of layer 552. In a non-limiting, preferred embodiment, electrode 58 has a thickness of around 50 nanometers. Suitable materials for electrode 58 include aluminum, copper, silver and gold. Preferably, electrodes 56 and 58 are made of the same material. The patterning operation performed on electrode 58 completes the typical preferred fabrication cycle, with the resultant device being shown in FIG. 5(*k*). The etching operation on electrode 58 results in a CMUT device with a transducer surface wherein access is provided to the first electrodes 56 of the membrane through pads 561 as well as to the second electrodes 58 in order to be able to drive the CMUT cells independently with the first and second electrodes 56 and 58.

Furthermore, in some particular cases and some cell configurations, and during the operation of removing of the sacrificial layer (FIG. 5(*f*)), the surface tension between the etching liquid and the silicon nitride layer tends to pull the said layer down as the etchant is removed. Indeed, once the nitride layer and silicon substrate are in contact, the VanderWals forces act to maintain the two components as they were, and the cells no longer function. Techniques that can be employed to prevent this phenomenon from occurring include chemical roughening of the silicon surface and sublimating the etchant liquid instead of evaporating the same. In fact, to prevent a sticking effect, the membrane of cells is preferably produced with a residual stress that counter-balances the VanderWals forces. Indeed, it has been demonstrated that membranes with internal stress from 100 to 400 MPa are well suited for vacuum sealed cavities, and, more particularly, stresses of 250 to 300 MPa are particularly desirable for CMUT devices.

Figure 7:
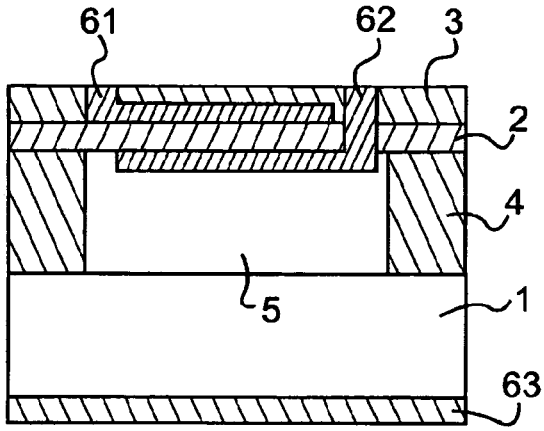
FIG. 7 is a cross sectional view of yet another embodiment of the invention.

As indicated above, the above described manufacturing method for CMUT devices is given here as an example of available techniques, and other methods, such as those using a highly doped silicon substrate as a support for the CMUT, can also be used according to the present invention, with no basic change in principle. For instance, front electrodes can be provided on the bottom face of each sub-membrane in order to reduce the dielectric losses between the front and bottom electrodes as illustrated in FIG. 7. More specifically, referring to FIG. 7, substrate 1 is provided with bottom electrode 63 which acts as a ground electrode for the system. Support 4 that supports the membranes 2 and 3 has created therein a void or cavity 5 through the removal of sacrificial material, as described above. A first electrode 62 is provided on the bottom face of membrane 2 and a second electrode 61 is provided on the front face of membrane 2 prior to the deposition of the membrane 3 that completes the CMUT cell fabrication. It is important to note that a protective layer (not shown) can be advantageously deposited on the front surface of this device.

The resonant frequency of a CMUT transducer is a function of the membrane diameter, and the residual stress and the density of the membrane. Because the latter parameters are process driven, the frequency of the transducers is, therefore, preferably adjusted by modifying the diameter of the cavities. Although any kind of cavity shape can be formed through use of the above described etching processes, rectangular shapes are, in general, to be avoided in order to provide better homogeneity with respect to the vibration of the membrane. However, shapes of a rectangular form can be used to more completely cover the surface of the substrate, thereby improving the efficiency of the transducer. Further, the electrostatic force exerted on the membranes varies inversely with the respect to thickness of the membrane and oxide membrane support, so that the thinner the oxide and nitride layers, the larger the electrostatic force that can be expected. Unfortunately, this also increases the risk of sticking occurring as discussed above. This, in practice, CMUT transducers are essentially designed by controlling, on one hand, the shape and size of the membrane/cavity and, on the other hand, the residual stress and density of the membrane. Failure to control one of these parameters can lead to loss of an sensitivity or excessive risk of sticking effects.

A further aspect of the present invention concerns the way in which fabrication of the CMUTs is carried out. In some circumstances, it will be desirable to implement other components (e.g., inductive, capacitive or active components) or signal conditioning functions on the substrate supporting the CMUT cells. One method concerns implementing the additional components or functions in the same process flow. However, this method dramatically complicates the process, thereby increasing fabrication costs and the risk of producing an unacceptable or failed device. The manufacturing method described herein is particularly well suited to the production of CMUT transducers wherein complementary components or functions are to be added directly on the wafer or substrate. In this method, the silicon substrate is processed before the membrane of the CMUT cells is deposited thereon and is optionally electrode plated. No removal of a sacrificial layer is then needed, thereby avoiding the production of a wafer having excessive fragility. The wafer can, therefore, be readily manipulated and handled, and wafer operations can be performed in a safe manner. Once the complementary operation on the wafer is complete, the CMUT fabrication operations can then be pursued in conventional fabrication process. This has the advantage of limiting the risk of producing a CMUT wafer having failed or broken cells.

Although the invention has been described above in relation to preferred embodiments thereof, it will be understood by those skilled in the art that variations and modifications can be effected in these preferred embodiments without departing from the scope and spirit of the invention.

What is claimed:

1. An ultrasonic transducer comprising a silicon substrate including a bottom electrode, a membrane support, a first front electrostatic membrane including a first front electrode and a second membrane disposed on said first membrane and including a second front electrode deposited on a top surface of the second membrane, said first and second membranes being supported by said membrane support, and said transducer further comprising interconnection paths for connecting the first and second front electrodes to an imaging system.

2. An ultrasonic transducer according to claim 1 wherein the first and second membranes comprise silicon nitride.

3. An ultrasonic transducer according to claim 1 wherein the first and second membranes comprise polysilicon.

4. An ultrasonic transducer according to claim 1 wherein the first membrane is comprised of silicon nitride and the second membrane is comprised of polysilicon.

5. An ultrasonic transducer according to claim 1 wherein the second membrane is comprised of silicon nitride and the first membrane is comprised of polysilicon.

6. An ultrasonic transducer according to claim 1 wherein the first membrane is thicker than the second membrane.

7. An ultrasonic transducer according to claim 1 wherein the first membrane is thinner than the second membrane.

8. An ultrasonic transducer according to claim 1 wherein said transducer comprises at least first and second front electrode groups, the first front electrode group being connected to a first electrical collector and the second front electrode group being connector to a further electrical connector.

9. An ultrasonic transducer comprising a silicon substrate having a bottom electrode, a membrane support disposed on a front surface of said silicon substrate, a front first electrostatic membrane including a first front electrode having a first shape and surface, and a second membrane disposed on said first membrane and including a second front electrode deposited on the top surface of the second membrane and having a second shape and surface, said first and second membrane being supported by said membrane support and said transducer further comprising interconnection paths for connecting the first and second front electrodes to an imaging system.

10. An ultrasonic transducer according to claim 9 wherein the first and second shapes and surfaces of said first and second front electrodes are substantially identical.

11. An ultrasonic transducer according to claim 9 wherein the first shape and surface of the first front electrode are different from the second shape and surface of the second front electrode.

12. An ultrasonic transducer according to claim 9 wherein the shape of the front electrodes is circular.

13. An ultrasonic transducer according to claim 9 wherein the shape of the front electrodes is polygonal.

14. An ultrasonic transducer according to claim 9 wherein the first and second electrodes are geometrically centered on the Z axis.

15. An ultrasonic transducer according to claim 9 wherein the first front electrode is geometrically shifted relative to the second front electrode.

16. An ultrasonic transducer comprising according to claim 9 wherein said transducer comprises at least first and second front electrode groups, the first front electrode group being connected to a first electrical collector and the second front electrode group being connected to a further electrical collector.

17. An ultrasonic transducer comprising a silicon substrate having a bottom electrode, a membrane support, a front electrostatic membrane having a thickness and including a front electrode provided in the thickness of said membrane, said front electrode having electrical pad extending out of a surface of said membrane and adapted to be connected to an electrical collector.

18. An ultrasonic transducer comprising a silicon substrate including a bottom electrode, a membrane support, a first front electrostatic membrane including a first electrode provided on the bottom face of said first membrane, and a second membrane disposed on said first membrane and including a second electrode deposited on a bottom surface of the second membrane, said first and second membranes being supported by said membrane support, and said transducer further comprising interconnection paths for connecting the first and second electrodes to an imaging system.

* * * * *